United States Patent [19]

Keritsis et al.

[11] 4,362,170

[45] Dec. 7, 1982

[54] TOBACCO CURING METHOD

[75] Inventors: Gus D. Keritsis, Richmond, Va.; Gordon H. Bokelman, Boulder, Colo.; Dewitt T. Gooden, III, Barnwell, S.C.

[73] Assignee: Philip Morris, Incorporated, New York, N.Y.

[21] Appl. No.: 214,493

[22] Filed: Dec. 9, 1980

[51] Int. Cl.[3] ..... A24B 3/12; A24B 15/20; A24B 15/28

[52] U.S. Cl. ..... 131/309

[58] Field of Search ..... 131/290, 297, 299, 300, 131/301, 302-306, 307, 309, 369, 359

[56] References Cited

U.S. PATENT DOCUMENTS

| | | | |
|---|---|---|---|
| 1,113,902 | 10/1914 | Lawrence et al. | 131/310 |
| 1,543,245 | 6/1925 | Buensod | 131/310 |
| 1,545,811 | 7/1925 | Buensod | 131/310 |
| 1,568,316 | 1/1926 | Buensod | 131/310 |
| 1,847,162 | 3/1932 | Andrews | 131/310 |
| 1,926,036 | 9/1933 | Chesley | 131/299 |
| 2,343,345 | 3/1944 | Touton | 131/310 |
| 3,086,533 | 4/1963 | Touton | 131/310 |
| 3,106,209 | 10/1963 | Torigian | 131/299 |
| 3,225,456 | 12/1965 | Touton | 131/310 |

*Primary Examiner*—V. Millin, Jr.

*Attorney, Agent, or Firm*—Arthur I. Palmer, Jr.; George E. Inskeep

[57] ABSTRACT

An artificial method of curing green tobacco is provided wherein the tobacco is exposed to sulfur dioxide gas. Curing can be effected by completely contacting the tobacco with sulfur dioxide gas and thereafter allowing the tobacco to brown until the desired color is achieved.

1 Claim, No Drawings

TOBACCO CURING METHOD

BACKGROUND OF THE INVENTION (a) Field of the Invention

This invention relates to a method for artificially curing green tobacco with sulfur dioxide.

(b) State of the Art

Green leaf curing and/or aging by suspending the leaves in darkness or otherwise disposing the leaves while controlling temperature and relative humidity of circulating air currents is disclosed in U.S. Pat. Nos. 1,113,902, 1,543,245, 1,545,811, 1,568,316, 2,343,345 and 3,086,553. Forced air flow through bundles of green leaves has also been suggested as a means to cure green tobacco in U.S. Pat. No. 3,225,456. Such conventional methods of curing tobacco, characteristically require several days and may entail substantial expenditures for fuel. Further such curing processes tend to be labor intensive. In contrast to the majority of prior art curing methods, the present invention provides a rapid and less labor and energy intensive means for eliminating the green color and green odor and taste of tobacco employing sulfur dioxide.

U.S. Pat. No. 1,847,162 describes a process wherein sulfur dioxide is employed alone or preferably in combination with benzoyl peroxide as a bleaching or brightening agent for tobacco hands. According to this process, tobacco hands are placed in an air or gas tight enclosure, moistened to sensitize the tobacco to the bleaching agent; and contacted with the bleaching agent in gaseous form for 20 minutes to four hours. The enclosure is then aerated to expel the gas and dry the tobacco. The tobacco's combustion properties are then restored by treatment with an appropriate agent such as potassium nitrate vapors. Thereafter the tobacco is again aerated to render it fresh. The bleached tobacco is particularly useful as cigar wrapper. In contrast to this prior art tobacco treatment process, the present invention employs sulfur dioxide to cure green tobacco.

SUMMARY OF THE INVENTION

This invention provides a method of artificially curing green tobacco by contacting the tobacco with sulfur dioxide gas. By means of this curing method, green tobacco becomes brown in as little as 15 to 45 minutes.

DETAILED DESCRIPTION OF THE INVENTION

The present invention provides a means for rapidly and economically curing green tobacco by exposing the tobacco to sulfur dioxide gas until the green color of the tobacco is eliminated.

The process of the invention has application to both living and harvested mature green tobacco including burley and bright tobaccos. Further the tobacco to be treated may be whole leaf or in pieces.

When treated according to the invention, the tobacco may be in fresh untreated form or may have been pressed to express juices therefrom and thereby reduce the content of alkaloids, nitrogen, reducing sugars or the like in the tobacco material. The pressed tobacco may optionally be allowed to dry prior to treatment according to the invention. However, for the curing to take place some moisture must remain in the tobacco. Generally at least 10 to 15% OV should be present for uniform curing in reasonable periods of time.

In the practice of the invention, the tobacco to be cured is disposed in a manner which permits ready access of air to its surfaces. For example, the tobacco, if in leaf form may be suspended in a manner which permits it to hang freely. The tobacco, when properly disposed is then exposed to sulfur dioxide gas. This can be accomplished by injecting sulfur dioxide gas into a vessel or chamber containing the tobacco. The vessel may be closed during this operation to effect greater control of the gas.

The period required for curing depends upon the color desired for the tobacco product. However, actual exposure of the tobacco to the sulfur dioxide gas requires only a very brief period of time, generally only that sufficient to ensure complete contact with the tobacco. As little as a few seconds, sometimes no more than 5, may be sufficient. As a result of such exposure curing is activated. Thereafter the browning process will proceed without further contact with sulfur dioxide gas.

The time required for a desired color change is also dependent on the nature of the material being treated. Generally, treatment of unpressed green tobacco for as little as 15 minutes is sufficient to eliminate the green color and convert the tobacco to a light brown color. Comparable color changes in dry pressed green tobacco require more time. Such color change typically can be effected in approximately 45 minutes.

After the tobacco has turned brown the tobacco may be dried. Either air drying or use of a forced dryer as is practiced in drying burley and bright tobaccos respectively may be employed. If bulk curing chambers conventionally employed to cure bright tobacco are used, both the sulfur dioxide exposure and the drying cycle could be effected therein.

Following the sulfur dioxide treatment the tobacco is preferably aired out in order to remove residual sulfur dioxide. Such airing effectively reduces the sulfur content of the tobacco to substantially the same levels as in untreated tobacco.

Tobacco treated in accordance with the invention has a form and color resembling conventionally cured tobacco. Moreover, the color is maintained with time.

The sulfur dioxide curing process of the invention provides a fast, effective and safe method of yellowing green tobacco material. Further, sulfur dioxide curing provides leaf material with form and color similar to conventional tobacco and when combined with pressing to express fluids gives a final product that does not need stemming or homogenization. The chemistry of the tobacco is not greatly altered by sulfur dioxide curing except for the loss of chlorophyll and possible minor residues of sulfur. Sulfur dioxide curing also reduces the length of the curing cycle, thus creating tremendous energy savings. In addition, the pressing and subsequent curing may drastically reduce labor requirements, especially in burley.

The following examples are illustrative of the invention:

EXAMPLE 1

Greenhouse grown mature Coker 411 leaves from mid-stalk, green and recently harvested, were divided in half along the midrib. One half of the leaves served as untreated control, while the other half (approximately 70 grams of green tobacco material) were exposed for 25 seconds to $SO_2$ gas and were then sealed in a one-gallon glass jar. The tobacco in the jar began to brown almost immediately and was about 50% brown in five minutes. Browning was complete in 15 minutes, the leaf having a golden-brown hue. The $SO_2$-treated material was left sealed in the jar for two hours and was then exposed to the air for several hours. Samples of untreated and $SO_2$-treated tobacco were submitted for sulfur analysis without drying. The results of the analysis were as follows:

| | % S | % Oven Volatiles | % S Dry Basis |
|---|---|---|---|
| $SO_3$—treated | 0.3 | 84.9 | 2.0 |
| Control | 0.2 | 90.8 | 2.2 |

Part of the treated material was dried to a moisture level usually found in conventional cigarette filler and was shredded and made into cigarettes. Similar control cigarettes were made with conventionally cured and aged filler. Expert smokers found the $SO_2$-treated cigarettes to be flatter, more acrid, less hot, and showing more aldehyde notes than the controls.

EXAMPLE 2

Sections of Coker 411 bright tobacco green leaf, about 3" by 1", both as-picked and pressed to expel liquids, were suspended by tape from the mouths of pint jars. The sections were hanging free in the jars. Gaseous $SO_2$ was introduced into the bottom of the jars in a hood for 15 seconds and the jars were then quickly capped. The unpressed leaf turned completely golden brown in 15 minutes, the pressed leaf turned this color in 45 minutes. When left exposed to the outside atmosphere for several days, the sections retained a desirable color.

EXAMPLE 3

A sample of green tobacco, Coker 319 bright, from the upper stalk position in the 16th week of plant growth, was harvested and pressed between felt belts on a roller press at about 780 pli (pounds per linear inch) and allowed to dry in a forced air oven at 40° C. The sample was then divided equally, 12 g each, to produce Samples A and B. Sample A was kept as the control.

Sample B was placed in a one-gallon glass jar and exposed to $SO_2$ gas for 25 seconds with the $SO_2$ cylinder valve wide open for maximum $SO_2$ delivery. At the end of this exposure of the pressed/dried tobacco to $SO_2$, the glass jar was sealed and put into the hood overnight. The next day parts of the $SO_2$-treated tobacco had achieved a light brown color but for the most part the treated tobacco was still green and similar to the Sample A control.

The treated tobacco was then humidified with steam (a few seconds) followed with an additional $SO_2$ treatment for 25 seconds, and allowed to stand in the resealed glass jar. This time the treated tobacco turned to a uniform yellow color almost immediately. The yellowed Sample B was then taken out of the jar and allowed to air dry for about 65 hours.

These results indicate that the $SO_2$ browning of green tobacco is achieved faster in the presence of moisture.

What is claimed is:

1. A method of artificially curing mature green tobacco from which juices have been expressed comprising contacting the tobacco having a moisture content of at least 10% OV with sulfur dioxide gas, allowing the sulfur dioxide treated tobacco to brown and drying the browned tobacco.

* * * * *